US010990043B2

(12) United States Patent
Nakamura et al.

(10) Patent No.: US 10,990,043 B2
(45) Date of Patent: Apr. 27, 2021

(54) FIXING DEVICE CONFIGURED TO RESTRAIN INCREASES IN ROTATIONAL TORQUE OF A FIXING MEMBER, IMAGE FORMING APPARATUS AND METHOD OF MANUFACTURING FIXING DEVICE

(71) Applicants: Makoto Nakamura, Kanagawa (JP); Takashi Tanaka, Kanagawa (JP)

(72) Inventors: Makoto Nakamura, Kanagawa (JP); Takashi Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/881,539

(22) Filed: May 22, 2020

(65) Prior Publication Data

US 2020/0393782 A1 Dec. 17, 2020

(30) Foreign Application Priority Data

Jun. 14, 2019 (JP) ..... JP2019-111418

(51) Int. Cl.
*G03G 15/20* (2006.01)

(52) U.S. Cl.
CPC ..... *G03G 15/2025* (2013.01)

(58) Field of Classification Search
CPC ..... G03G 15/2017; G03G 15/2025; G03G 15/2053; G03G 15/2057; G03G 15/206
USPC ..... 399/325, 329, 333
See application file for complete search history.

(56) References Cited

U.S. PATENT DOCUMENTS

| | | | | |
|---|---|---|---|---|
| 7,711,305 | B2 * | 5/2010 | Matsumoto | G03G 15/2057 399/329 |
| 9,760,046 | B2 * | 9/2017 | Lim et al. | G03G 15/2053 |
| 10,317,828 | B2 * | 6/2019 | Naitoh et al. | G03G 15/2025 |

FOREIGN PATENT DOCUMENTS

| | | |
|---|---|---|
| JP | 2009-014893 | 1/2009 |
| JP | 2018-101036 | 6/2018 |

* cited by examiner

*Primary Examiner* — William J Royer
(74) *Attorney, Agent, or Firm* — Harness, Dickey & Pierce, P.L.C.

(57) ABSTRACT

A fixing device receives a recording material having a toner image and applies pressure and heat to fix the toner image. The fixing device includes a fixing member, a sliding member, a pressing member, and a heating member. The fixing member has a rotatable endless belt shape that includes an inner circumferential resin layer. The sliding member is pressed against the inner circumferential surface of the fixing member with a lubricant interposed between the sliding member and the inner circumferential surface. The sliding member has a resin coating layer and slides on the inner circumferential surface. The pressing member presses the recording material toward an outer circumferential surface of the fixing member. The heating member generates heat to heat the recording material. A surface hardness of the inner circumferential surface of the fixing member is smaller than a surface hardness of the sliding surface of the sliding member.

10 Claims, 3 Drawing Sheets

FIXING DEVICE CONFIGURED TO RESTRAIN INCREASES IN ROTATIONAL TORQUE OF A FIXING MEMBER, IMAGE FORMING APPARATUS AND METHOD OF MANUFACTURING FIXING DEVICE

CROSS-REFERENCE TO RELATED APPLICATION

This patent application is based on and claims priority pursuant to 35 U.S.C. § 119(a) to Japanese Patent Application No. 2019-111418, filed on Jun. 14, 2019, in the Japan Patent Office, the entire disclosure of which is hereby incorporated by reference herein.

BACKGROUND

Technical Field

The present disclosure relates to a fixing device that fixes a toner image onto a recording material, an image forming apparatus including the fixing device and a method of manufacturing the fixing device.

Description of the Related Art

A fixing device is known that receives a recording material between a rotatable endless belt-shaped fixing member and a pressing member and applies pressure and heat to fix a toner image.

In such a fixing device, in many cases, a sliding member that is pressed against an inner circumferential surface of the rotating fixing member and slides over the inner circumferential surface is disposed to effectively sandwich the recording material between the fixing member and the pressing member. The pressing member presses the recording material toward a portion corresponding to the sliding member on an outer circumferential surface of the fixing member to press the recording material. In such a fixing device, a lubricant is supplied between the inner circumferential surface of the fixing member and the sliding member to restrain an increase in the rotational torque of the fixing member. At this time, abrasion powder generated by abrasion of the inner circumferential surface of the fixing member and the sliding member over time is mixed with the lubricant, and the viscosity of the lubricant increases and the lubricating performance decreases. As a result, the rotational torque may increase.

SUMMARY

In an aspect of the present disclosure, a fixing device receives a recording material having a toner image formed on a surface of the recording material and applies pressure and heat to the recording material, and fixes the toner image to the recording material. The fixing device includes a fixing member, a sliding member, a pressing member, and a heating member. The fixing member has a rotatable endless belt shape that includes an inner circumferential resin layer, which is an inner circumferential surface of the fixing member. The sliding member is pressed against the inner circumferential surface of the fixing member with a lubricant interposed between the sliding member and the inner circumferential surface to slide on the inner circumferential surface. The sliding member has a resin coating layer whose surface is a sliding surface to slide on the inner circumferential surface. The pressing member presses the recording material toward a portion of an outer circumferential surface of the fixing member corresponding to the sliding member. The heating member is provided in at least one of the fixing member and the pressing member and generates heat to heat the recording material. A surface hardness of the inner circumferential surface of the fixing member is smaller than a surface hardness of the sliding surface of the sliding member.

In another aspect of the present disclosure, a method of manufacturing a fixing device that receives a recording material having a toner image formed on a surface of the recording material, applies pressure and heat to the recording material to fix the toner image onto the recording material. The method includes a step of obtaining a fixing member, a step of obtaining a sliding member, a step of obtaining a pressing member, and a step of obtaining a heating member. The fixing member has a rotatable endless belt shape that includes an inner circumferential resin layer which is an inner circumferential surface of the fixing member. The sliding member is pressed against the inner circumferential surface of the fixing member with a lubricant interposed between the sliding member and the inner circumferential surface of the fixing member. The sliding member includes a resin coating layer whose surface is a sliding surface to slide on the inner circumferential surface of the fixing member. The pressing member presses the recording material toward a portion of an outer circumferential surface of the fixing member corresponding to the sliding member. The heating member is provided in at least one of the fixing member and the pressing member and generates heat to heat the recording material. The step of obtaining the fixing member and the step of obtaining the sliding member obtain the fixing member and the sliding member such that a surface hardness of the inner circumferential surface of the fixing member is smaller than a surface hardness of the sliding surface of the sliding member.

In still another aspect of the present disclosure, an image forming apparatus includes a housing, an image forming device, and a fixing device. The image forming device is disposed inside the housing and forms a toner image on a surface of a recording material. The fixing device is disposed inside the housing and receives the recording material having the toner image formed on the surface of the recording material and applies pressure and heat to fix the toner image to the recording material. The fixing device includes a fixing member, a sliding member, a pressing member, and a heating member. The fixing member has a rotatable endless belt shape that includes an inner circumferential resin layer being an inner circumferential surface of the fixing member. The sliding member is pressed against the inner circumferential surface of the fixing member with a lubricant interposed between the sliding member and the inner circumferential surface of the fixing member to slide on the inner circumferential surface. The sliding member has a resin coating layer whose surface is a sliding surface to slide on the inner circumferential surface. The pressing member presses the recording material toward a portion of an outer circumferential surface of the fixing member corresponding to the sliding member. The heating member is provided in at least one of the fixing member and the pressing member and generates heat to heat the recording material. A surface hardness of the inner circumferential surface of the fixing member is smaller than a surface hardness of the sliding surface of the sliding member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
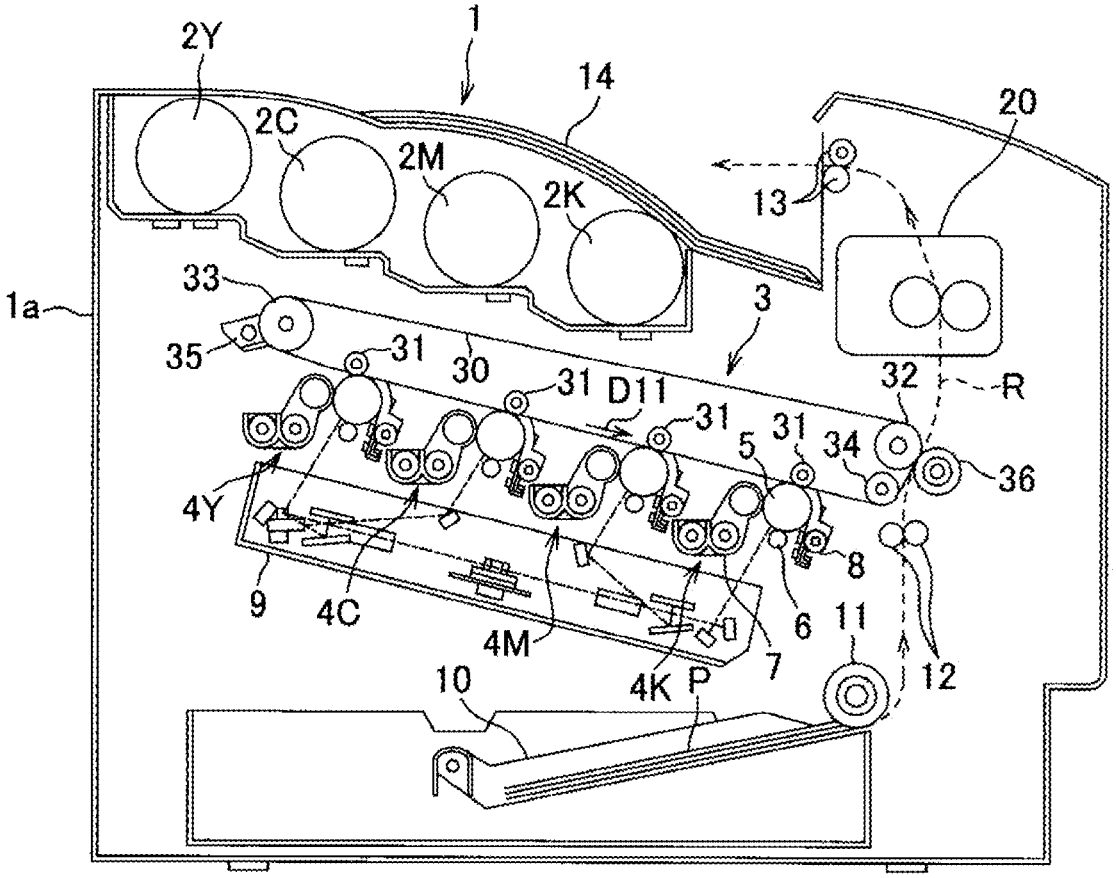
FIG. 1 is a schematic view of a configuration of an image forming apparatus according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure arc described below. In the drawings for explaining the following embodiments, the same reference codes are allocated to elements (members or components) having the same function or shape and redundant descriptions thereof are omitted below.

Hereinafter, a description is given of a fixing device, an image forming apparatus, and a method of manufacturing the fixing device according to embodiments of the present disclosure. First, a first embodiment is described.

FIG. 1 is a schematic view of a configuration of the image forming apparatus according to the first embodiment.

An image forming apparatus 1 illustrated in FIG. 1 is an electrophotographic color laser printer, and four image forming devices 4Y, 4C, 4M, and 4K are arranged in a center portion of the image forming apparatus 1. The image forming devices 4Y, 4C, 4M, and 4K are aligned in a direction in which an intermediate transfer belt 30 is stretched. The image forming devices 4Y, 4C, 4M, and 4K have the same configuration except that images are formed with toners of different colors of yellow (Y), cyan (C), magenta (M), and black (K) corresponding to color separation components of a color image.

Each of the image forming devices 4Y, 4C, 4M, and 4K includes a drum-shaped photoconductor 5 as an electrostatic latent image bearer, a charger 6 to charge a surface of the photoconductor 5, a developing device 7 to develop the electrostatic latent image with toner, and a cleaner 8 to clean the surface of the photoconductor 5. Note that, in FIG. 1, only the photoconductor 5, the charger 6, the developing device 7, and the cleaner 8 of the image forming device 4K for black are denoted by reference numerals.

An exposure device 9 is disposed below the image forming devices 4Y, 4M, 4C, and 4K and exposes outer circumferential surfaces of the respective photoconductors 5 with laser beams. The exposure device 9 irradiates the surface of each photoconductor 5 with a laser beam to form an electrostatic latent image based on image data.

A transfer device 3 is disposed above the image forming devices 4Y, 4C, 4M, and 4K. The transfer device 3 includes the intermediate transfer belt 30, four primary transfer rollers 31, and a secondary transfer roller 36. The transfer device 3 further includes a secondary transfer backup roller 32, a cleaning backup roller 33, a tension roller 34, and a belt cleaner 35.

The intermediate transfer belt 30 is an endless belt that is stretched by the secondary transfer backup roller 32, the cleaning backup roller 33, and the tension roller 34, and circulates and moves in a direction of arrow D11 in FIG. 1. Toner images on the photoconductors 5 of the image forming devices 4Y, 4C, 4M, and 4K arc primarily transferred onto the intermediate transfer belt 30.

The four primary transfer rollers 31 sandwich the intermediate transfer belt 30 together with the four photoconductors 5, forming four primary transfer nips between the intermediate transfer belt 30 and the photoconductors 5, respectively. A primary transfer voltage is applied to each primary transfer roller 31, and the toner images on the photoconductors 5 in the image forming devices 4Y, 4C, 4M, and 4K are primarily transferred to the intermediate transfer belt 30 by the primary transfer voltage.

The secondary transfer roller 36 and the secondary transfer backup roller 32 sandwich the intermediate transfer belt 30 to form a secondary transfer nip. A secondary transfer voltage is applied to the secondary transfer roller 36, and the toner image on the intermediate transfer belt 30 is secondarily transferred by the secondary transfer voltage onto a sheet P as a recording material.

The belt cleaner 35 is disposed in contact with the intermediate transfer belt 30, and removes residual toner and the like from the intermediate transfer belt 30 after the secondary transfer.

The above-described image forming devices 4Y, 4C, 4M, and 4K and the transfer device 3 are disposed inside a housing 1*a* and serve as an image forming unit that forms a toner image on the sheet P as the recording material.

Four toner bottles 2Y, 2C, 2M, and 2K containing replenishment toner are detachably attached to an upper portion of the housing 1*a* of the image forming apparatus 1. A supply path is provided between each of the toner bottles 2Y, 2C, 2M, and 2K and each of the developing devices 7, and toner is supplied to each of the developing devices 7 through the supply path.

In a lower portion of the housing 1*a*, a sheet feeding tray 10 in which sheets P are accommodated, a sheet feeding roller 11 that conveys the sheets P from the sheet feeding tray 10, and the like are provided. Examples of the recording material includes sheets P such as plain paper, thick paper, postcards, envelopes, thin paper, coated paper (coated paper, art paper, or the like), tracing paper, and the like, as well as OHP sheets and the like. In addition to the sheet feeding tray 10, a known manual sheet feed mechanism may be provided in the housing 1*a*.

Inside the housing 1*a*, a conveyance path R is provided to eject the sheet P from the sheet feeding tray 10 to the outside of the image forming apparatus 1 through the second transfer nip. In the conveyance path R, a pair of registration rollers 12 as conveyors to convey the sheet P to the second transfer nip is disposed upstream from the secondary transfer roller 36 in a sheet conveyance direction. A fixing device 20 that fixes the toner image transferred onto the sheet P is disposed downstream from the secondary transfer roller 36 in the sheet conveyance direction. Further, a pair of sheet ejection rollers 13 to eject the sheets to the outside of the image forming apparatus 1 is provided downstream from the fixing device 20 in the sheet conveyance direction. A sheet ejection tray 14 to stack sheets ejected outside the image forming apparatus 1 is provided on a top surface of the housing 1*a*.

Next, a basic operation of the image forming apparatus 1 illustrated in FIG. 1 is described. When an image forming operation is started, the photoconductors 5 of the image forming devices 4Y, 4C, 4M, and 4K are driven to rotate, and the surfaces of the photoconductors 5 are charged by the chargers 6. An electrostatic latent image based on each color separation image of yellow, cyan, magenta, and black (YCMK) is formed on the surface of each charged photoconductor 5 by a laser beam from the exposure device 9. The electrostatic latent image formed on each photoconductor 5 is developed by each developing device 7, and a toner image of each color is formed on each photoconductor 5.

In parallel with formation of the toner image, the intermediate transfer belt 30 circulates. By the primary transfer voltage applied to each primary transfer roller 31, the toner image of each color on each photoconductor 5 is sequentially transferred onto the intermediate transfer belt 30 in a superimposed manner at the primary transfer nip. With the superimposition, a four-color composite toner image is formed on the intermediate transfer belt 30. Deposits such as residual toner on the photoconductors 5 after the primary transfer are removed by the cleaners 8. Thereafter, the outer circumferential surface of each photoconductor 5 is discharged to initialize the surface potential thereof.

On the other hand, the sheet P is fed from the sheet feeding tray 10 to the conveyance path R by the rotation of the sheet feeding roller 11 and is conveyed to the second transfer nip by the pair of registration rollers 12. The sheet P is fed by the pair of registration rollers 12 at a timing when the toner image on the intermediate transfer belt 30 reaches the second transfer nip. At the second transfer nip, the toner image on the intermediate transfer belt 30 is transferred to the sheet P by the second transfer voltage applied to the secondary transfer roller 36. Deposits such as residual toner on the intermediate transfer belt 30 after the second transfer are removed by the belt cleaner 35.

The sheet P after the second transfer is conveyed to the fixing device 20, and the toner image on the sheet P is fixed to the sheet P by the fixing device 20. The sheet P after the fixing is ejected to the outside of the image forming apparatus 1 by the sheet ejection rollers 13, and is stacked on the sheet ejection tray 14.

The above describes the image forming operation of the image forming apparatus 1 to form the full color toner image on the sheet P. Alternatively, the image forming apparatus 1 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

Next, a configuration of the fixing device 20 is described.

Figure 2:
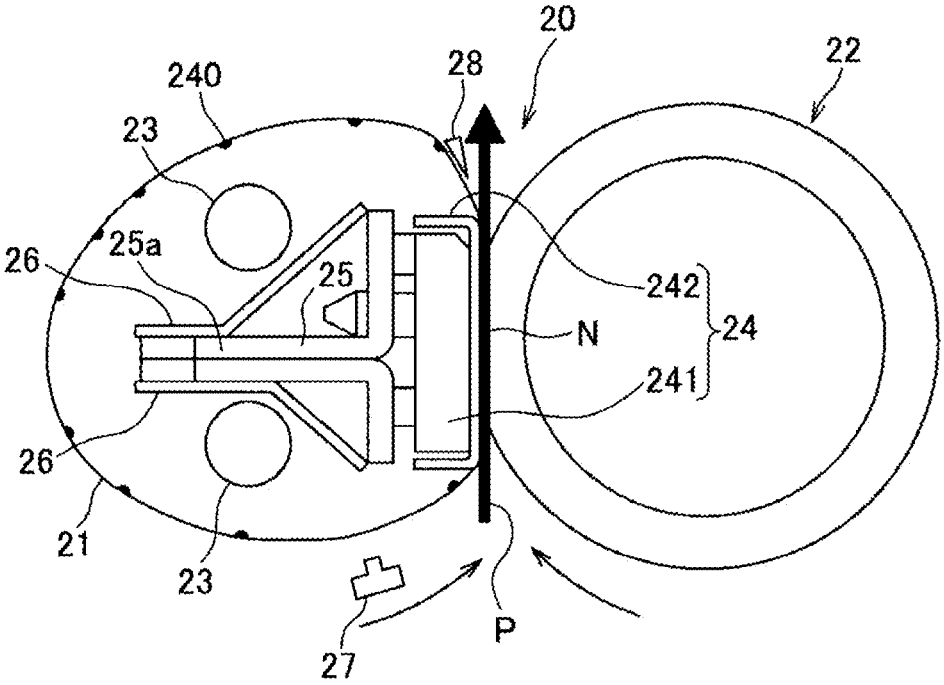
FIG. 2 is a schematic cross-sectional view of a fixing device illustrated in FIG. 1.

FIG. 2 is a schematic cross-sectional view of the fixing device 20 illustrated in FIG. 1.

The fixing device 20 includes an endless belt-shaped fixing member 21 and a roller-shaped pressing member 22 that presses the sheet P toward the fixing member 21. Inside the fixing member 21 (inside the loop formed by the fixing member 21), two halogen heaters 23 are provided as heating members that generate heat. Further, inside the fixing member 21, a sliding member 24 and a stay 25 are disposed. The sliding member 24 is pressed against the inner circumferential surface of the rotating fixing member 21 with a lubricant 240 interposed therebetween and slides the inner circumferential surface of the fixing member 21. The stay 25 fixes and supports the sliding member 24. A reflector 26 is interposed between each halogen heater 23 and the stay 25 in the fixing member 21. Further, a temperature sensor 27 to control the output of the halogen heaters 23 is provided on a receiving side of the sheet P on the outer circumferential side of the fixing member 21, and a separator 28 to separate the sheet P from the fixing member 21 is provided on an ejection side of the sheet P.

The fixing member 21 has an endless belt shape having a small thickness and a small diameter like a film to achieve a low heat capacity. The fixing member 21 includes an endless belt-shaped base material, an inner circumferential resin layer formed on an inner circumference of the base material, and an outer circumferential resin layer formed on an outer circumference of the base material. The base material is made of metal such as nickel, copper, or stainless use steel (SUS), or resin such as polyimide. Each resin layer is made of, for example, tetrafluoroethylene-perfluoroalkylvinylether copolymer resin (PFA), polytetrafluoroethylene (PTFE), polyamide-imide resin (PAI), or polyimide resin (PI). The outer circumferential resin layer serves as a release layer that facilitates release of the sheet P from the fixing member 21. In the present embodiment, the inner circumferential resin layer and the outer circumferential resin layer are made of a mixed resin mixed with the PAI resin and the PTFE resin.

The pressing member 22 includes a hollow roller-shaped core metal, an elastic layer made of silicone rubber foam, fluoro rubber, or the like provided on a surface of the core metal, and a release layer made of PFA, PTFE, or the like provided on a surface of the elastic layer. The pressing member 22 is pressed against a portion of the outer circumferential surface of the fixing member 21 contacting the sliding member 24. At this portion pressed between the pressing member 22 and the fixing member 21, the elastic layer of the pressing member 22 is compressed to form a fixing nip N. When the pressing member 22 is driven to rotate, the fixing member 21 is rotated by the rotation of the pressing member 22. The fixing member 21 rotates while being sandwiched between the sliding member 24 and the pressing member 22 at the fixing nip N, and travels while being guided by side plate flanges disposed at both end portions of the fixing member 21 outside the fixing nip N. When the sheet P is fed into the fixing nip N, the pressing member 22 presses the sheet P toward a portion contacting the sliding member 24 on the outer circumferential surface of the fixing member 21 in the fixing nip N, thereby pressing the sheet P. The pressing member 22 may be formed in a solid cylindrical shape instead of the hollow shape as described in the present embodiment.

The two halogen heaters 23 are disposed inside the fixing member 21 and sandwiches a vertical bar portion of the stay 25 having a T-shaped cross section. Each of the halogen heaters 23 is disposed on each side of the stay 25. The halogen heaters 23 heat the fixing member 21 with radiant heat, and heat the sheet P, which is fed into the fixing nip N and pressed, via the fixing member 21. In the present embodiment, the halogen heaters 23 as heaters are provided inside the fixing member 21. However, the heaters may be provided, for example, inside the pressing member 22 formed as a hollow roller shape.

As described above, the sliding member 24 is disposed inside the fixing member 21 to form the fixing nip N in cooperation with the pressing member 22. The sliding member 24 is pressed against the inner circumferential surface of the rotating fixing member 21 with the lubricant 240 interposed between the sliding member 24 and the fixing member 21 to slide over the inner circumferential surface of the fixing member 21. The sliding member 24 will be described later with reference to other drawings.

The stay 25 is formed to have a T-shaped cross section, and the two halogen heaters 23 are separated from each other by an upright portion 25*a* that is a T-shaped vertical rod. Such a configuration restrains a decrease in heating efficiency due to one halogen heater 23 heating the other halogen heater 23.

Each reflector 26 is disposed between the stay 25 and each halogen heater 23, and separates the stay 25 and each halogen heater 23 from each other. Such a configuration reduces wasteful energy consumption caused by heating the stay 25 by radiant heat from the halogen heaters 23.

The temperature sensor 27 is disposed outside the outer circumferential surface of the fixing member 21 at a side at which the sheet P is received into the fixing nip N. The temperature sensor 27 measures the temperature of the fixing member 21 to control the output of the halogen heaters 23.

The separator 28 is disposed outside the circumferential surface of the fixing member 21 at a side which the sheet P is ejected from the fixing nip N. The separator 28 is a separation claw that separates the sheet P having passed through the fixing nip N from the outer circumferential surface of the fixing member 21.

Next, the sliding member 24 provided to form the fixing nip N is described.

Figure 3:
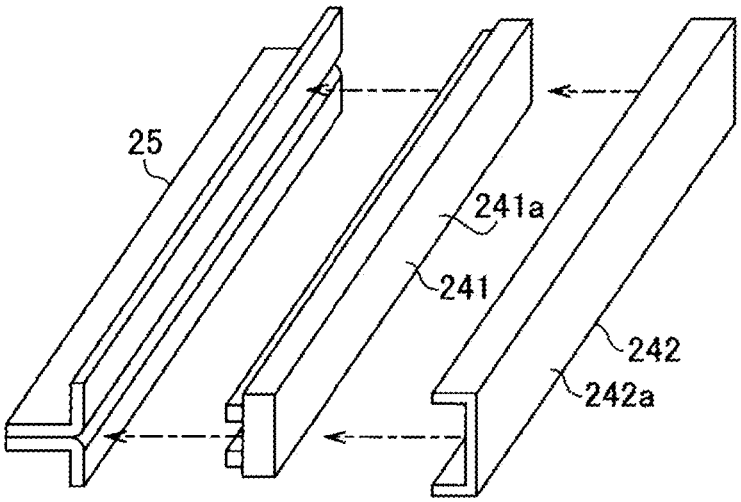
FIG. 3 is a perspective view of a sliding member whose cross sections is illustrated in FIG. 2 together with a stay to fix and support the sliding member.

FIG. 3 is a perspective view of the sliding member 24 whose cross section is illustrated in FIG. 2 together with the stay 25 that fixes and supports the sliding member 24.

The sliding member 24 includes a nip forming member 241 and a thermal conduction aid 242 as a pressed member. The nip forming member 241 is disposed inside the inner circumferential surface of the fixing member 21, and sandwiches the fixing member 21 between the nip forming member 241 and the pressing member 22. Thus, the fixing nip N is formed. The thermal conduction aid 242 is disposed inside the loop formed by the fixing member 21 in a position facing the nip forming member 241 and is pressed against the inner circumferential surface of the fixing member 21. Further, the thermal conduction aid 242 has a higher thermal conductivity than the fixing member 21.

The nip forming member 241 is secured and supported by the stay 25 and has a substantially rectangular parallelepiped shape extending in a width direction of the fixing member 21 as a longitudinal direction of the nip forming member 241. The nip forming member 241 is made of a heat-resistant material having high mechanical strength and a heat-resistant temperature not less than 200° C. More specifically, the nip forming member 241 is made of heat resistant resin such as polyimide (PT), polyether ether ketone (PEEK), or liquid crystal polymer (LCP) reinforced with glass fiber. Thus, deformation of the nip forming member 241 due to heat is prevented in a toner fixing temperature range and a stable fixing nip state is ensured to stabilize output image quality. Examples of a method of fixing the nip forming member 241 to the stay 25 include a locking method in which a locking portion is provided on one member and a locked portion is provided on the other member, and a method such as adhesion.

Similar to the nip forming member 241, the stay 25 and the circular tubular halogen heaters 23 also extend in the width direction of the fixing member 21 so that the width direction of the fixing member 21 is a longitudinal direction of each of the stay 25 and the circular tubular halogen heaters 23. The stay 25 fixes and supports the nip forming member 241 having the substantially rectangular parallelepiped shape. The halogen heaters 23 are disposed to sandwich the upright portion 25*a* of the stay 25. Both ends of each of the stay 25 and the halogen heaters 23 in the longitudinal direction are fixed and held by side plates of the fixing device 20 or holders provided separately.

The thermal conduction aid 242 is a portion having a C-shaped cross section and extending in the width direction of the fixing member 21 with substantially the same length as the length of the nip forming member 241 having a substantially rectangular parallelepiped shape. The thermal conduction aid 242 is fitted to cover a surface of the nip forming member 241 facing the inner circumferential surface of the fixing member 21. As a method of fixing the thermal conduction aid 242 to the nip forming member 241, similar to the method of fixing the nip forming member 241 to the stay 25, a locking method, an adhesion method, or the like may be used.

A surface of the thermal conduction aid 242 facing the inner circumferential surface of the fixing member 21 is a sliding surface 242*a* that slides on the inner circumferential surface of the fixing member 21. Since a surface 241*a* of the nip forming member 241 facing the pressing member 22 has a greater mechanical strength, the surface 241*a* substantially serves as a nip forming surface.

In the present embodiment, the thermal conduction aid 242 has a following cross-sectional structure.

Figure 4:
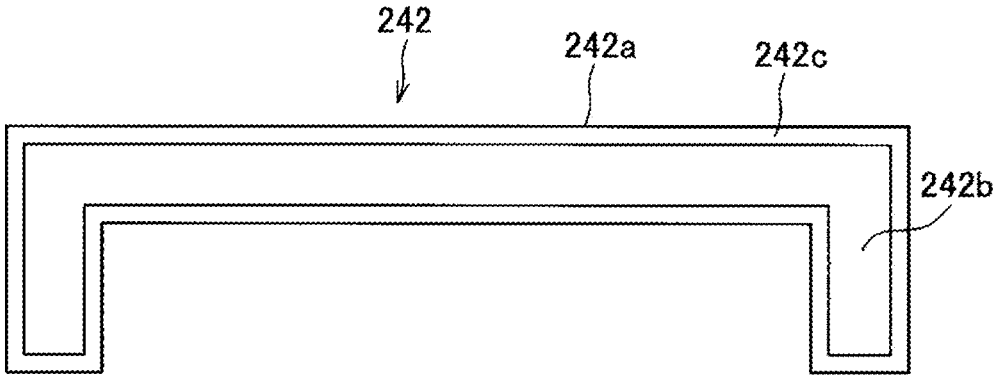
FIG. 4 is a schematic view illustrating a cross-sectional structure of a supplementary thermal conductor illustrated in FIG. 2.

FIG. 4 is a schematic view of a cross-sectional structure of the thermal conduction aid 242 illustrated in FIG. 2.

The thermal conduction aid 242 includes a body portion 242*b* made of metal and a resin coating layer 242*c*. A surface of the resin coating layer 242*c* facing the fixing member 21 serves as the sliding surface 242*a* that contacts the inner circumferential surface of the fixing member 21.

The body portion 242*b* of the thermal conduction aid 242 is made of metal, such as copper or aluminum, having a high thermal conductivity. Thus, the thermal conduction aid 242 actively transfers heat in the width direction of the fixing member 21, that is, in the longitudinal direction of the thermal conduction aid 242, thereby eliminating the temperature unevenness in the longitudinal direction.

The resin coating layer 242*c* is formed by applying a resin such as PFA, PTFE, PAI, or PI over the entire surface of the body portion 242*h* as a low friction treatment to smooth the sliding surface 242*a* and to reduce the rotational torque of the fixing member 21. In the present embodiment, the resin coating layer 242*c* is formed of a resin mixture of the PI resin and the PFA resin.

When the surface hardness of the inner circumferential surface of the endless belt-shaped fixing member 21 is Hs1 and the surface hardness of the sliding surface 242*a* of the thermal conduction aid 242 formed as described above, that is, the sliding surface 242*a* of the sliding member 24 is Hs2, Hs1 is smaller than Hs2. In the present embodiment, the interior resin layer of the fixing member 21 is formed such that the surface hardness Hs1 of the inner circumferential surface thereof is F to HB in terms of hardness in a pencil hardness test prescribed in Japanese Industrial Standards (JIS) K 5600-5-4. Further, the resin coating layer 242*c* of the thermal conduction aid 242 of the sliding member 24 is formed such that the surface hardness of the sliding surface 242*a* is 2H to 6H in the pencil hardness test prescribed in JIS K 5600-5-4.

The lubricant 240 is interposed between the sliding surface 242*a* of the sliding member 24 and the inner circumferential surface of the fixing member 21 to reduce the sliding resistance and restrain the rotational torque of the fixing member 21. The sliding surface 242*a* is provided with asperities to retain the lubricant 240.

The lubricant 240 includes a grease containing a fluorine oil such as polytetrafluoroethylene or a silicone oil as a base oil, an additive, and a solid lubricant, PTFE, or the like as a thickener. In the present embodiment, fluorine oil is used for the base oil. Semi-fluid or extremely soft grease having a consistency of about 00 to 0 grade based on National Lubricating Grease Institute (NLGI) standard is used to maintain low torque. When fluorine oil is used as the base oil, heat resistance and chemical stability are higher than a base oil using silicone oil. Therefore, even if there is a heat source in the fixing member 21, volatilization loss and deterioration of the base oil can be restrained.

Further, when the surface roughness of the inner circumferential surface of the endless belt-shaped fixing member 21 is Ra1 and the surface roughness of the sliding surface 242*a* of the sliding member 24 due to the above-described asperities is Ra2, Ra1 is smaller than Ra2. In the present embodiment, the surface roughness Ra1 of the inner circumferential surface of the interior resin layer of the fixing member 21 is 0.2 μm to 0.5 μm in arithmetic average roughness defined in JIS B 0601-2001. Further, in the resin coating layer 242*c* of the thermal conduction aid 242 of the sliding member 24, the surface roughness Ra2 of the sliding surface 242*a* is in a range of 0.2 μm to 0.7 μm in arithmetic average roughness defined in JIS B 0601-2001 and larger than the arithmetic average roughness of the inner circumferential surface of the fixing member 21.

The fixing device manufacturing method to manufacture the fixing device 20 described above includes a fixing member production step, a sliding member production step, a pressing member production step, a heating member production step, and an assembling step.

The fixing member production step is a step to obtain the fixing member 21. A rotatable endless belt-shaped base material is formed of a metal such as nickel, copper, or SUS, or a resin material such as polyimide. An inner circumferential resin layer and an outer circumferential resin layer are formed of a resin such as PFA, PTFE, PAI, or PI to obtain the fixing member 21. As described above, in the present embodiment, the inner circumferential resin layer and the outer circumferential resin layer are made of the mixed resin mixed with the PAI resin and the PTFE resin.

The sliding member production step is a step to obtain the sliding member 24 by forming the nip forming member 241 and the thermal conduction aid 242, and combining the nip forming member 241 and the thermal conduction aid 242. The nip forming member 241 is made of a heat-resistant material and has a substantially rectangular parallelepiped shape. The resin coating layer 242*c* is formed around the outer surface of the body portion 242*b* to form the thermal conduction aid 242. The body portion 242*b* is formed in a C-shaped cross section made of a metal material having high thermal conductivity such as copper or aluminum. The resin coating layer 242*c* is made of a resin such as PFA, PTFE, PAI, or PI. As described above, in the present embodiment, the resin coating layer 242*c* is formed of the mixed resin mixed with the PI resin and the PFA resin.

The pressing member production step is a step to obtain the pressing member 22. An elastic layer made of silicone rubber foam, fluoro rubber, or the like is formed on the surface of a hollow roller-shaped core metal and a release layer made of PFA, PTFE, or the like is formed on the surface of the elastic layer to obtain the pressing member 22.

The heating member production step is a step to obtain two circular tubular halogen heaters 23 as heating members.

The assembling step is a step to assemble the fixing device 20. Members, such as the fixing member 21, the sliding member 24, the pressing member 22, and the halogen heaters 23 obtained in the respective steps described above and components such as the stay 25, the reflector 26, the temperature sensor 27, and the separator 28 arc attached to the frame to assemble the fixing device 20.

Here, in the above-described fixing member production step and the sliding member production step, the mixing ratio, the layer thickness, and the like of the mixed resin are adjusted such that the surface hardness Hs1 of the inner circumferential surface of the fixing member 21 is smaller than the surface hardness Hs2 of the sliding surface 242*a* of the sliding member 24. Further, in the above-described steps, the following adjustment is performed so that the surface roughness Ra1 of the inner circumferential surface of the fixing member 21 is smaller than the surface roughness Ra2 of the sliding surface 242*a* of the sliding member 24. That is, the surface roughness of the base material of the fixing member 21, the surface roughness of the body portion 242*b* of the thermal conduction aid 242, the resin application condition, and the like are adjusted so that the surface roughness has such a magnitude relation as described above.

In the fixing device 20, the fixing device manufacturing method, and the image forming apparatus 1 according to the first embodiment described above with reference to FIGS. 1 to 4, the surface hardness Hs1 of the inner circumferential surface of the fixing member 21 is smaller than the surface hardness Hs2 of the sliding surface 242*a* of the sliding member 24. As a result, the inner circumferential surface of the fixing member 21 is more easily worn than the sliding surface 242*a* of the sliding member 24. At this time, since the surface area of the inner circumferential surface of the fixing member 21 is larger than the surface area of the sliding surface 242*a* of the sliding member 24, the progress speed of the wear is slower than a case in which the magnitude relation of the surface hardness is reversed. Thus, since the amount of abrasion powder generated over time is restrained, an increase in viscosity due to mixing of the lubricant 240 and the abrasion powder is also restrained, and an increase in rotation torque of the endless belt-shaped fixing member 21 over time can be sufficiently restrained.

In the present embodiment, the sliding member 24 includes the nip forming member 241 and the thermal conduction aid 242 covering the nip forming member 241 and having high thermal conductivity. The thermal conduction aid 242 includes the sliding surface 242*a* contacting the inner circumferential surface of the fixing member 21. According to this configuration, the thermal conduction aid 242 having a higher thermal conductivity than the fixing member 21 is pressed against the inner circumferential surface of the fixing member 21. Thus, since the temperature of the circumferential surface of the fixing member 21 can be made uniform, fixing unevenness and the like can be effectively restrained.

In the present embodiment, the thermal conduction aid 242 includes the body portion 242*b* made of metal, and the resin coating layer 242*c* is formed around the body portion 242*b*. Such a configuration can further reduce wear between the resin coating layer 242*c* and the inner circumferential surface of the fixing member 21 while securing high thermal conductivity with the body portion 242*b* made of metal.

Further, in the present embodiment, the sliding surface 242*a* of the sliding member 24 is provided with asperities to retain the lubricant 240. According to this configuration, the lubricant 240 can be retained by the asperities provided on the sliding surface 242*a*, thus further reducing wear between the sliding surface 242*a* and the inner circumferential surface of the fixing member 21.

In the present embodiment, the surface hardness Hs1 of the inner circumferential surface of the fixing member 21 is F to HB in the pencil hardness test defined in HS K 5600-5-4, and the surface hardness Hs2 of the sliding surface 242*a* of the sliding member 24 is 2H to 6H in the pencil hardness test. The surface hardness of the above described surfaces is set to such hardness. Therefore, the amount of abrasion powder generated over time can be effectively restrained.

In the present embodiment, the interior resin layer of the fixing member 21 and the resin coating layer 242*c* of the sliding member 24 are both formed of a mixed resin of a polyamide-imide resin and a polytetrafluoroethylene resin. Such a configuration enables the above-described magnitude relation to be obtained with high accuracy while effectively adjusting the surface hardness Hs1 of the inner circumferential surface of the fixing member 21 and the surface hardness Hs2 of the sliding surface 242*a* of the sliding member 24.

In the present embodiment, the surface roughness Ra2 of the sliding surface 242*a* of the sliding member 24 is larger than the surface roughness Ra1 of the inner circumferential surface of the fixing member 21. According to this configuration, the sliding surface 242*a* is rougher than the inner circumferential surface of the fixing member 21. Thus, it is possible to retain the lubricant 240 favorably on the sliding surface 242*a*, and further reduce the wear between the sliding surface 242*a* and the inner circumferential surface of the fixing member 21.

In the present embodiment, the surface roughness Ra1 of the inner circumferential surface of the fixing member 21 is 0.2 μm to 0.5 μm in arithmetic average roughness defined in JIS B 0601-2001. The surface roughness Ra2 of the sliding surface 242*a* of the sliding member 24 is within the range of 0.2 μm to 0.7 μm and larger than the arithmetic average roughness Ra1 of the inner circumferential surface of the fixing member 21. The surface roughness of each of the above described surfaces is set to the above described roughness. Thus, it is possible to increase the retainability of the lubricant 240 in a contact area in which a sliding surface of the sliding member 24 slidably contacts the inner circumferential surface of the fixing member 21, and to effectively restrain the amount of abrasion powder generated over time.

The description of the first embodiment has been completed. Next, a second embodiment will be described. In the second embodiment, a configuration of a sliding member 54 is different from the above-described configuration of the sliding member 24 of the first embodiment. On the other hand, other configurations are similar to configurations of the first embodiment. In the following, the second embodiment will be described focusing on differences from the first embodiment.

Figure 5:
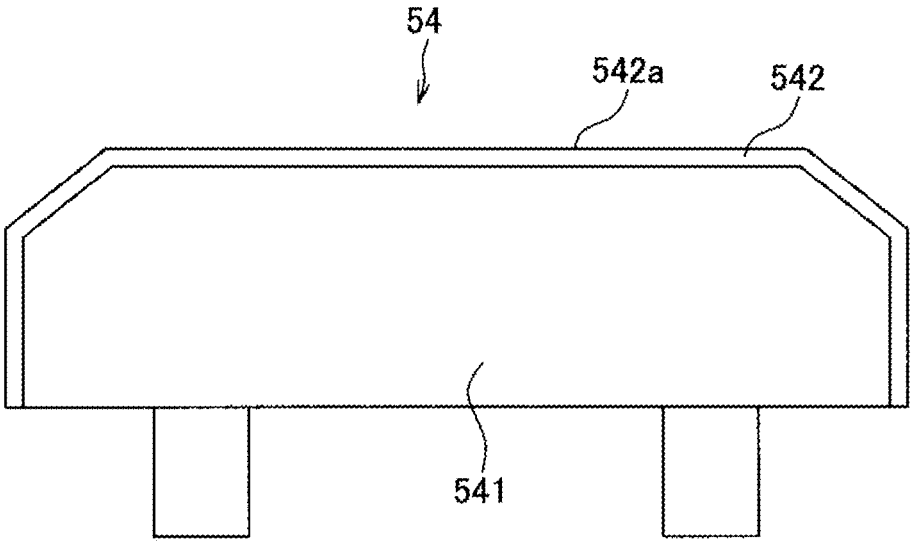
FIG. 5 is a schematic view of a cross-sectional structure of a sliding member according to a second embodiment.

FIG. 5 is a schematic view of a cross-sectional structure of the sliding member 54 according to the second embodiment.

The sliding member 54 of the present embodiment includes a substantially rectangular parallelepiped body portion 541 that is fixed and supported by the stay 25 illustrated in FIGS. 2 and 3 and extends in the width direction of the fixing member 21 as the longitudinal direction. A resin coating layer 542 made of the mixed resin of the PI resin and the PFA resin is formed on a surface of the body portion 541 that is an inner circumferential surface of the fixing member 21. The surface of the resin coating layer 542 on the inner circumferential surface of the fixing member 21 is a sliding surface 542*a* of the sliding member 54.

In the present embodiment, when the surface hardness of the inner circumferential surface of the endless belt-shaped fixing member 21 is Hs1 and the surface hardness of the sliding surface 542*a* of the sliding member 54 is Hs2, Hs1 is smaller than Hs2. Also, in the present embodiment, the surface hardness Hs1 of the inner circumferential surface of the fixing member 21 is F to HB in the pencil hardness test, whereas the surface hardness of the sliding surface 242*a* of the sliding member 54 is 2H to 6H in the pencil hardness test. When the surface roughness of the inner circumferential surface of the endless belt-shaped fixing member 21 is Ra1 and the surface roughness of the sliding surface 542*a* of the sliding member 54 is Ra2, Ra1 is smaller than Ra2. Also, in the present embodiment, the surface roughness Ra1 of the inner circumferential surface of the fixing member 21 is 0.2 μm to 0.5 μm in arithmetic average roughness. On the other hand, the surface roughness Ra2 of the sliding surface 242*a* of the sliding member 54 is within the range of 0.2 μm to 0.7 μm in arithmetic average roughness, the surface roughness Ra2 is larger than the arithmetic average roughness Ra1 of the inner circumferential surface of the fixing member 21.

According to the second embodiment described above, similarly to the first embodiment described above, the increase of the rotational torque of the endless belt-shaped fixing member 21 over time can be sufficiently restrained. However, the thermal conduction aid 242 having high thermal conductivity can effectively restrain the fixing unevenness, similarly to the above-described case of the sliding member 24 of the first embodiment.

In the present embodiment, the resin coating layer 542 of the sliding member 54 is formed of a mixed resin of a PI resin and a PFA resin. Forming the resin coating layer 542 of the sliding member 54 with the above-described resin also enables the above-described magnitude relation to be obtained with high accuracy while effectively adjusting the surface hardness Hs1 of the inner circumferential surface of the fixing member 21 and the surface hardness Hs2 of the sliding surface 542*a* of the sliding member 54.

Note that the fixing device and the image forming apparatus according to the above-described embodiments are merely representative examples, and the fixing device and the image forming apparatus of the present disclosure are not limited to these embodiments. That is, a person skilled in the art can carry out various modifications in accordance with conventionally known knowledge.

For example, in the first and second embodiments described above, the electrophotographic image forming apparatus 1 is exemplified as an example of the image forming apparatus. However, the image forming apparatus is not limited to the electrophotographic image forming apparatus and may be, for example, an inkjet image forming apparatus.

In the first embodiment described above, the thermal conduction aid 242 in which the resin coating layer 242*c* is formed on the metal body portion 242*b* is exemplified as an example of the pressed member. However, the pressed member is not limited thereto, and the specific cross-sectional configuration thereof is not limited. However, according to the configuration in which the resin coating layer 242*c* is formed on the metal body portion 242*b*, it is possible to further reduce wear while securing high thermal conductivity, as described above.

In the first and second embodiments described above, as an example of the sliding member, the sliding member 24 and the sliding member 54 are exemplified. The sliding member 24 and the sliding member 54 are provided with asperities that retain the lubricant 240 on the sliding surface 242*a* and the sliding surface 542*a*, respectively, contacting the inner circumferential surface of the fixing member 21. However, the sliding member is not limited to the above example, and the surface thereof may not be provided with asperities. Note that the sliding surface 242*a* and the sliding surface 542*a* are provided with asperities to retain the lubricant 240 and thus, it is possible to further reduce wear between the sliding surfaces 242*a* and 524*a* and the inner circumferential surface of the fixing member 21.

In the first and second embodiments described above, the surface hardness Hs1 of the inner circumferential surface of the fixing member 21 is F to HB in terms of hardness in the pencil hardness test, and the surface hardness Hs2 of the sliding surface 242*a* of the sliding member 24 is 2H to 6H in terms of hardness in the pencil hardness test. However, specific values of the surface hardness of each surface are not limited to the values described above, and may be arbitrarily set. Note that, setting the surface hardness of each surface to the above-described hardness can effectively restrain the amount of abrasion powder generated over time, as described above.

In the above-described first embodiment, the interior resin layer of the fixing member 21 and the resin coating layer 242*c* of the sliding member 24 are both formed of a mixed resin of the PAI resin and the PTFE resin. Further, in the second embodiment, the interior resin layer of the fixing member 21 is formed of the same mixed resin as described above, but the resin coating layer 542 of the sliding member 54 is formed of a mixed resin of the PI resin and the PFA resin. However, the interior resin layer of the fixing member 21 and the resin coating layer of the sliding member 54 may be formed of any resin. Note that forming each layer with the above mixed resin enables the above-described magnitude relation between the surface hardness Hs1 of the inner circumferential surface of the fixing member 21 and the surface hardness Hs2 of each of the sliding surface 242*a* of the sliding member 24 and the sliding surface 542*a* of the sliding member 54 to be obtained with high accuracy, as described above.

In the above-described first and second embodiments, as an example of the fixing device, the fixing device 20 is exemplified. In the fixing device 20, the surface roughness Ra2 of each of the sliding surface 242*a* of the sliding member 24 and the sliding surface 542*a* of the sliding member 54 is larger than the surface roughness Ra1 of the inner circumferential surface of the fixing member 21. However, the fixing device is not limited thereto, and the magnitude relation between the surface roughness of the inner circumferential surface of the fixing member and the surface roughness of the sliding surface of the sliding member can be arbitrarily set. Note that, the surface roughness Ra2 of the sliding surface 242*a* of the sliding member 24 is larger than the surface roughness Ra1 of the inner circumferential surface of the fixing member 21. Thus, wear can be further reduced, as described above.

In the first and second embodiments, the surface roughness Ra1 of the inner circumferential surface of the fixing member 21 is 0.2 μm to 0.5 μm in arithmetic average roughness. The surface roughness Ra2 of each of the sliding surface 242*a* of the sliding member 24 and the sliding surface 542*a* of the sliding member 54 is within the range of 0.2 μm to 0.7 μm and is larger than the arithmetic average roughness of the inner circumferential surface of the fixing member 21. However, specific values of the surface roughness of each surface are not limited to the above values, and may be arbitrarily set. Note that setting the surface roughness of each surface to the above-described hardness can increase the retainability of the lubricant contacting portions of each surface and to effectively restrain the amount of abrasion powder generated over time, as described above.

In addition, in the first and second embodiments described above, specific methods to provide asperities on the sliding surface 242*a* and the sliding surface 542*a* or to make the surface roughness Ra2 of each of the sliding surface 242*a* and the sliding surface 542*a* larger than the surface roughness Ra1 of the inner circumferential surface of the fixing member 21 are not described. Examples of such a method, for example, includes a method of forming a desired shape with asperities or a large roughness on a surface of the body portion 242*b* made of metal in the thermal conduction aid 242 of the first embodiment or the inner circumferential surface of the fixing member 21 of the body portion 541 of the second embodiment. Alternatively, resin may be applied to surfaces of the above members to form a desired shape with asperities or large roughness on the sliding surface 242*a* and the sliding surface 542*a*.

EXAMPLES

Next, examples of a fixing device and an image forming apparatus corresponding to the above-described first embodiment are described together with comparative examples as comparison targets. Note that following embodiments are merely examples, and the present disclosure is not limited thereto.

Example 1

In Example 1, first, as a fixing member 21, an inner circumferential resin layer made of a mixed resin of a PAI resin and a PTFE resin and having a thickness of 15 μm was formed on an inner circumferential surface of a substrate by a spray method. The substrate had an endless belt-shape and was made of a nickel (Ni)/copper (Cu) alloy, and had a total thickness of 40 μm. The mixing ratio of the PAI resin to the PTFE resin was PAI:PTFE=4:6.

In the present example, the film hardness (surface hardness of the inner circumferential surface) of the inner circumferential resin layer of the fixing member 21 is F in the pencil hardness test defined in JIS K 5600-5-4. The film surface roughness of the inner circumferential resin layer (surface roughness of the inner circumferential surface) was 0.2 μm in arithmetic average roughness Ra defined by JIS B 0601-2001.

The sliding member 24 includes the thermal conduction aid 242 that includes a body portion 242*b* and a resin coating layer 242*c*. The body portion 242*b* was formed of an aluminum sheet having a thickness of 0.6 mm. The resin coating layer 242*c* was made of a mixed resin of a PAI resin and a PTFE resin and was formed at a thickness of 16 μm on the body portion 242*b* by a spray method. The mixing ratio of the PAI resin to the PTFE resin was PAI:PTFE=7:3.

The resin coating layer 242*c* was formed so that the film hardness (surface hardness of the sliding surface 242*a*) was 2H in the pencil hardness test defined in ITS K 5600-5-4. The surface roughness of the resin coating layer 242*c* (surface roughness of the sliding surface 242*a*) was formed to have a thickness of 0.7 μm in arithmetic average roughness Ra defined in JIS B 0601-2001.

The fixing device 20 includes the fixing member 21 and the sliding member 24 formed as described above. A durable operation in which the fixing member 21 was rotated by the number of rotations corresponding to 178 km in terms of a running distance was performed. Thereafter, the rotation torque of the fixing member 21 was evaluated.

In the evaluation of the rotation torque, when the rotation torque exceeds 0.5 Nm, it was determined as "poor" because of difficulty in continuous operation. Also, an evaluation result in which the rotation torque is not greater than 0.5 Nm and exceeds 0.3 Nm is determined as "fair" in that a continuous operation is possible. Another evaluation result in which the rotation torque is not greater than 0.3 Nm is determined as "good" in that the continuous operation is possible more stably.

Example 2

In Example 2, the conditions were the same as the conditions in Example 1 as described above except for the film hardness and the film surface roughness of the inner circumferential resin layer of the fixing member 21 and the film hardness and the film surface roughness of the resin coating layer 242*c* of the thermal conduction aid 242 in the sliding member 24. In Example 2, the mixing ratio of the resin is PAI:PTFE=3:7 in the inner circumferential resin layer of the fixing member 21 and PAI:PTFE=8:2 in the resin coating layer 242*c* of the thermal conduction aid 242.

In Example 2, the film hardness of the inner circumferential resin layer of the fixing member 21 is set to HB in the pencil hardness test defined in JIS K 5600-5-4, and the film surface roughness is set to 0.5 μm in arithmetic average roughness Ra defined in BS B 0601-2001. The film hardness of the resin coating layer 242*c* of the thermal conduction aid 242 is set to 3H in the pencil hardness test defined in JIS K 5600-5-4, and the film surface roughness is set to 1.5 μm in arithmetic average roughness Ra defined in JIS B 0601-2001.

Example 3

The fixing device 20 incorporating the fixing member 21 and the sliding member 24 formed as described above was evaluated in the same manner as in Example 1.

In Example 3, the conditions were the same as those in Example 1 except for the configuration of the resin coating layer 242*c* of the thermal conduction aid 242 in the sliding member 24.

In Example 3, first, the fixing member 21 having the same conditions as those of Example 1 was used.

On the other hand, the thermal conduction aid 242 of the sliding member 24 includes the resin coating layer 242*c*. The body portion 242*b* was formed of an aluminum sheet metal having a thickness of 0.6 mm. The resin coating layer 242*c* was made of a mixed resin of PI resin and PFA resin and was formed at a thickness of 10 μm by a spray method on a surface of the body portion 242*b*. The mixing ratio of the resin was PI:PTFE=7:3.

The resin coating layer 242*c* has a film hardness (surface hardness of the sliding surface 242*a*) of 5H in the pencil hardness test defined in JIS K 5600-5-4, and a coating film surface roughness of 0.2 μm in arithmetic average roughness Ra defined in JIS B 0601-2001.

Example 4

The fixing device 20 incorporating the fixing member 21 and the sliding member 24 formed as described above was evaluated in the same manner as in Example 1.

In Example 4, the conditions were the same as those in Example 2 except for the configuration of the resin coating layer 242*c* of the thermal conduction aid 242 in the sliding member 24.

In Example 4, first, the fixing member 21 having the same conditions as those of Example 2 was used.

On the other hand, the thermal conduction aid 242 of the sliding member 24 includes the resin coating layer 242*c*. The body portion 242*b* was formed of an aluminum sheet metal having a thickness of 0.6 mm. The resin coating layer 242*c* was made of a mixed resin of PI resin and PFA resin and was formed at a thickness of 10 μm by the spray method on a surface of the body portion 242*b*. The mixing ratio of the resin is PI:PFA=8:2.

The resin coating layer 242*c* had a film hardness (surface hardness of the sliding surface 242*a*) of 6H in the pencil hardness test defined in JIS K 5600-5-4, and a film surface roughness of 0.5 μm in arithmetic average roughness Ra defined in JIS B 0601-2001.

Comparative Example 1

The fixing device 20 incorporating the fixing member 21 and the sliding member 24 formed as described above was evaluated in the same manner as in Example 1.

In Comparative Example 1, the conditions were the same as those of Example 1 except for the film hardness and the film surface roughness of the inner circumferential resin layer of the fixing member 21 and the film hardness and the film surface roughness of the resin coating layer 242*c* of the thermal conduction aid 242 in the sliding member 24. In Comparative Example 1, the mixing ratio of the resin is PAI:PTFE=6:4 in the inner circumferential resin layer of the fixing member 21, and PAI:PTFE=4:6 in the resin coating layer 242*c* of the thermal conduction aid 242.

In the present comparative example, the film hardness of the inner circumferential resin layer of the fixing member 21 is H in the pencil hardness test defined in JIS K 5600-5-4, and the film surface roughness is 0.8 μm in arithmetic average roughness Ra defined in JIS B 0601-2001. In addition, the film hardness of the resin coating layer 242*c* of the thermal conduction aid 242 is F in the pencil hardness test defined in JIS K 5600-5-4, and the film surface roughness is 0.3 μm in arithmetic average roughness Ra defined in JIS B 0601-2001.

Comparative Example 2

The fixing device 20 incorporating the fixing member 21 and the sliding member 24 formed as described above was evaluated in the same manner as in Example 1.

In Comparative Example 2, the same conditions as those in Example 1 were used except for the film hardness and the film surface roughness of the inner circumferential resin layer of the fixing member 21 and the film hardness and the film surface roughness of the resin coating layer 242*c* of the thermal conduction aid 242 in the sliding member 24. In Comparative Example 2, the mixing ratio of the resin is PAI:PTFE=6:4 in the inner circumferential resin layer of the fixing member 21, and PAI:PTFE=4:6 in the resin coating layer 242*c* of the thermal conduction aid 242.

In the present comparative example, the film hardness of the inner circumferential resin layer of the fixing member 21 is H in the pencil hardness test defined in JIS K 5600-5-4, and the film surface roughness is 0.7 μm in arithmetic average roughness Ra defined in JIS B 0601-2001. In addition, the film hardness of the resin coating layer 242*c* of the thermal conduction aid 242 is F in the pencil hardness test defined in JIS K 5600-5-4, and the film surface roughness is 0.4 μm in arithmetic average roughness Ra defined in JIS B 0601-2001.

The fixing device 20 incorporating the fixing member 21 and the sliding member 24 formed as described above was evaluated in the same manner as in Example 1.

Evaluation

The evaluation results of the four examples and the two comparative examples described above are summarized in Table 1.

TABLE 1

Evaluation Results

| | Film Hardness of Inner Circumferential Surface of Fixing Belt | Film Surface Roughness of Inner Circumferential Surface of Fixing Belt (μm) | Film Hardness of Thermal Conduction Aid | Film Surface Roughness of Thermal Conduction Aid (μm) | Rotation Torque after Durable Test (Nm) | Evaluation Result |
|---|---|---|---|---|---|---|
| Embodiment 1 | F | 0.2 | 2H | 0.7 | 0.21 | Good |
| Embodiment 2 | HB | 0.5 | 3H | 1.5 | 0.28 | Good |
| Embodiment 3 | F | 0.2 | 5H | 0.2 | 0.46 | Fair |
| Embodiment 4 | HB | 0.5 | 6H | 0.5 | 0.40 | Fair |
| Comparative Example 1 | H | 0.8 | F | 0.3 | 0.76 | Poor |
| Comparative Example 2 | H | 0.7 | F | 0.4 | 0.66 | Poor |

In both of the two comparative examples, the rotational torque of the fixing member 21 is increased, and the evaluation results are "poor". On the other hand, in each of the four examples in which the film hardness (surface hardness of the sliding surface 242*a*) of the resin coating layer 242*c* of the thermal conduction aid 242 was larger than the film hardness (surface hardness of the inner circumferential surface) of the inner circumferential resin layer of the fixing member 21, continuous operation was possible. From the above evaluation results, it was confirmed that the surface hardness of the sliding surface 242*a* of the sliding member 24 being larger than the surface hardness of the inner circumferential surface of the fixing member 21 is effective to restrain the rotation torque of the fixing member 21 over time.

Among the four examples, in the first and second examples, the film surface roughness (surface roughness of the sliding surface 242*a*) of the resin coating layer 242*c* of the thermal conduction aid 242 is larger than the film surface roughness (surface roughness of the inner circumferential surface) of the inner circumferential resin layer of the fixing member 21. On the contrary, in the second and third examples, the film surface roughness of the inner circumferential resin layer of the fixing member 21 (the surface roughness of the inner circumferential surface) and the film surface roughness of the resin coating layer 242*c* of the thermal conduction aid 242 (the surface roughness of the sliding surface 242*a*) are substantially the same. In the evaluation results, the second and third examples were evaluated as "poor", whereas the first and second examples were evaluated as "fair". From the evaluation results, it was confirmed that the surface roughness of the sliding surface 242*a* of the sliding member 24 being larger than the surface roughness of the inner circumferential surface of the fixing member 21 is more effective to restrain the rotation torque of the fixing member 21 over time.

In the above descriptions, the term "printing" in the present disclosure may be used synonymously with, e.g. the terms of "image formation", "recording", "printing", and "image printing". Further, the coater according to an embodiment of the present disclosure can also be applied to an apparatus that performs printing on an electrophotographic process on a sheet material coated with a coating liquid.

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing device configured to receive a recording material having a toner image formed on a surface of the recording material, apply pressure and heat to the recording material, and fix the toner image to the recording material, the fixing device comprising:

a fixing member of a rotatable endless belt shape that includes an inner circumferential resin layer being an inner circumferential surface of the fixing member;

a sliding member pressed against the inner circumferential surface of the fixing member with a lubricant interposed between the sliding member and the inner circumferential surface to slide on the inner circumferential surface, the sliding member having a resin coating layer whose surface is a sliding surface to slide on the inner circumferential surface;

a pressing member configured to press the recording material toward a portion of an outer circumferential surface of the fixing member corresponding to the sliding member; and a heating member provided in at least one of the fixing member and the pressing member and configured to generate heat to heat the recording material, wherein the sliding member includes a nip forming member and a pressed member, the nip forming member disposed inside an inner circumference of the fixing member and configured to sandwich the fixing member between the nip forming member and the pressing member to form a fixing nip, and the pressed member disposed at a side facing the fixing member and pressed against the inner circumferential surface of the fixing member, the pressed member having a higher thermal conductivity than the fixing member and includes the sliding surface, and a surface hardness of the inner circumferential surface of the fixing member is smaller than a surface hardness of the sliding surface of the sliding member.

2. The fixing device according to claim 1, wherein the pressed member includes a body made of metal, and wherein the resin coating layer is formed of a resin applied to a surface of the body.

3. The fixing device according to claim 1, wherein the sliding surface of the sliding member is provided with asperities configured to retain the lubricant.

4. The fixing device according to claim 1, wherein a surface hardness of the inner circumferential surface of the fixing member is F to HB in a pencil hardness test defined in JIS K 5600-5-4, and a surface hardness of the sliding surface of the sliding member is 2H to 6H in the pencil hardness test defined in JIS K 5600-5-4.

5. The fixing device according to claim 1, wherein a surface roughness of the inner circumferential surface of the fixing member is smaller than a surface roughness of the sliding surface of the sliding member.

6. The fixing device according to claim 5, wherein the surface roughness of the inner circumferential surface of the fixing member is in a range of 0.2 μm to 0.5 μm in arithmetic average roughness defined in JIS B 0601-2001, wherein the surface roughness of the sliding surface of the sliding member is in a range of 0.2 μm to 0.7 μm in arithmetic average roughness defined in JIS B 0601-2001, and wherein the surface roughness of the sliding surface of the sliding member is larger than the surface roughness of the inner circumferential surface of the fixing member in arithmetic average roughness defined in JIS B 0601-2001.

7. The fixing device according to claim 1, wherein each of the inner circumferential resin layer of the fixing member and the resin coating layer of the sliding member is made of a mixed resin of a polyamide-imide resin and a polytetrafluoroethylene resin.

8. The fixing device according to claim 1, wherein the resin coating layer of the sliding member is made of a mixed resin of a polyimide resin and a tetrafluoroethylene-perfluoroalkyl vinyl ether copolymer resin.

9. A method of manufacturing a fixing device configured to receive a recording material having a toner image formed on a surface of the recording material, apply pressure and heat to the recording material to fix the toner image onto the recording material, the method comprising:

obtaining a fixing member of a rotatable endless belt shape that includes an inner circumferential resin layer being an inner circumferential surface of the fixing member;

obtaining a sliding member pressed against the inner circumferential surface of the fixing member with a lubricant interposed between the sliding member and the inner circumferential surface of the fixing member, the sliding member including a resin coating layer whose surface is a sliding surface to slide on the inner circumferential surface of the fixing member;

obtaining a pressing member configured to press the recording material toward a portion of an outer circumferential surface of the fixing member corresponding to the sliding member; and obtaining a heating member provided in at least one of the fixing member and the pressing member and configured to generate heat to heat the recording material, wherein the obtaining the fixing member and the obtaining the sliding member obtain the fixing member and the sliding member such that, the sliding member includes a nip forming member and a pressed member, the nip forming member disposed inside an inner circumference of the fixing member and configured to sandwich the fixing member between the nip forming member and the pressing member to form a fixing nip, and the pressed member disposed at a side facing the fixing member and pressed against the inner circumferential surface of the fixing member, the pressed member having a higher thermal conductivity than the fixing member and includes the sliding surface, and a surface hardness of the inner circumferential surface of the fixing member is smaller than a surface hardness of the sliding surface of the sliding member.

10. An image forming apparatus comprising:

a housing;

an image forming device disposed inside the housing and configured to form a toner image on a surface of a recording material; and a fixing device disposed inside the housing configured to receive the recording material having the toner image formed on the surface of the recording material and apply pressure and heat to fix the toner image to the recording material, the fixing device including:

a fixing member of a rotatable endless belt shape that includes an inner circumferential resin layer being an inner circumferential surface of the fixing member;

a sliding member pressed against the inner circumferential surface of the fixing member with a lubricant interposed between the sliding member and the inner circumferential surface of the fixing member to slide on the inner circumferential surface, the sliding member having a resin coating layer whose surface is a sliding surface to slide on the inner circumferential surface;

a pressing member configured to press the recording material toward a portion of an outer circumferential surface of the fixing member corresponding the sliding member; and a heating member provided in at least one of the fixing member and the pressing member and configured to generate heat to heat the recording material, wherein the sliding member includes a nip forming member and a pressed member, the nip forming member disposed inside an inner circumference of the fixing member and configured to sandwich the fixing member between the nip forming member and the pressing member to form a fixing nip, and the pressed member disposed at a side facing the fixing member and pressed against the inner circumferential surface of the fixing member, the pressed member having a higher thermal conductivity than the fixing member and includes the sliding surface, and a surface hardness of the inner circumferential surface of the fixing member is smaller than a surface hardness of the sliding surface of the sliding member.

* * * * *